US009748694B2

(12) United States Patent
Nonen et al.

(10) Patent No.: US 9,748,694 B2
(45) **Date of Patent: *Aug. 29, 2017**

(54) CONNECTOR AND CONNECTORIZED CABLE

(71) Applicant: Hitachi Metals, Ltd., Toyko (JP)

(72) Inventors: Hideki Nonen, Mito (JP); Yoshiaki Ishigami, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/069,350

(22) Filed: Mar. 14, 2016

(65) Prior Publication Data

US 2016/0294114 A1 Oct. 6, 2016

(30) Foreign Application Priority Data

Apr. 2, 2015 (JP) ..... 2015-076367

(51) Int. Cl.

| | |
|---|---|
| ***H01R 13/627*** | (2006.01) |
| ***H01R 13/633*** | (2006.01) |
| *H01R 13/629* | (2006.01) |
| *H01R 13/512* | (2006.01) |
| *H01R 13/66* | (2006.01) |

(52) U.S. Cl.

CPC ..... *H01R 13/6335* (2013.01); *H01R 13/6273* (2013.01); *H01R 13/512* (2013.01); *H01R 13/629* (2013.01); *H01R 13/6658* (2013.01)

(58) Field of Classification Search

CPC ..... H01R 13/6335

USPC ..... 439/352

See application file for complete search history.

(56) References Cited

U.S. PATENT DOCUMENTS

| | | | | |
|---|---|---|---|---|
| 7,226,316 | B2 | 6/2007 | Wu | |
| 7,354,292 | B1 | 4/2008 | Lloyd | |
| 7,402,070 | B1 * | 7/2008 | Wu | H01R 13/635 439/152 |
| 7,841,887 | B2 | 11/2010 | Zhang | |
| 8,064,207 | B2 | 11/2011 | Wu | |
| 8,202,122 | B2 * | 6/2012 | Wu | H01R 13/6581 439/352 |
| 8,267,718 | B2 * | 9/2012 | Straka | H01R 9/034 439/497 |

(Continued)

*Primary Examiner* — Abdullah Riyami
*Assistant Examiner* — Nader Alhawamdeh
(74) *Attorney, Agent, or Firm* — Roberts Mlotkowski Safran Cole & Calderon P.C.

(57) ABSTRACT

A connector for being fitted to an other member so as to be prevented from disengaging by a locking piece on the other member includes a connector housing including a recessed portion engaged with the locking piece, and a sliding member that slidably moves relative to the connector housing. The connector housing is formed by coupling a first housing member and a second housing member, a tip portion of the locking piece coming into sliding contact with a side surface having the recessed portion when removing the connector housing from the other member. At least a portion of a seam between the first and second housing members on the side surface is inclined relative to a direction of attaching/detaching to/from the other member, the portion being firstly crossed by the tip portion of the locking piece when removing the connector housing from the other member.

19 Claims, 8 Drawing Sheets

(56) References Cited

U.S. PATENT DOCUMENTS

| | | | | |
|---|---|---|---|---|
| 8,388,366 | B2 * | 3/2013 | Yang | H01R 13/6335 439/357 |
| 8,556,646 | B2 * | 10/2013 | Kappla | G02B 6/4246 439/352 |
| 8,668,515 | B2 | 3/2014 | Wu | |
| 8,708,752 | B2 | 4/2014 | Wu | |
| 8,747,141 | B2 * | 6/2014 | Crain | H01R 13/6272 439/258 |
| 8,814,229 | B2 | 8/2014 | Togami | |
| 9,071,003 | B2 * | 6/2015 | Lindkamp | H01R 13/50 |
| 9,478,910 | B2 | 10/2016 | Nonen | |
| 2004/0062493 | A1 * | 4/2004 | Ishigami | G02B 6/3897 385/92 |
| 2005/0059290 | A1 * | 3/2005 | Ishigami | G02B 6/4201 439/372 |
| 2006/0078260 | A1 * | 4/2006 | Ishigami | G02B 6/4246 385/92 |
| 2008/0124089 | A1 * | 5/2008 | Ishigami | C25D 13/12 398/139 |
| 2010/0194119 | A1 * | 8/2010 | Ishigami | H01R 13/627 292/128 |
| 2011/0031385 | A1 * | 2/2011 | Ishigami | G02B 6/4214 250/239 |
| 2012/0018624 | A1 * | 1/2012 | Baba | G02B 6/4201 250/214.1 |
| 2012/0027364 | A1 * | 2/2012 | Tamura | G02B 6/4201 385/92 |
| 2012/0282790 | A1 * | 11/2012 | Wang | H01R 13/6335 439/153 |
| 2016/0233613 | A1 * | 8/2016 | Nonen | H01R 13/6275 |
| 2016/0294114 | A1 * | 10/2016 | Nonen | H01R 13/629 |

* cited by examiner

CONNECTOR AND CONNECTORIZED CABLE

The present application is based on Japanese patent application No. 2015-076367 filed on Apr. 2, 2015, the entire contents of which are incorporated herein by reference.

BACKGROUND OF THE INVENTION

1. Field of the Invention

The invention relates to a connector which is prevented from disengaging by a locking piece on a mating member, and a connectorized cable equipped with the connector.

2. Description of the Related Art

Some connectors for being inserted to a cage having a shielding function etc. are prevented from disengaging by the locking piece equipped with the cage. The connectors are provided with a member for disengaging the locking piece in order to release the locking (see, e.g., U.S. Pat. No. 8,388,366).

The connector disclosed in U.S. Pat. No. 8,388,366 has a recess formed on a side surface of a rectangular parallelepiped-shaped connector housing, so that the locking piece is engaged with the recess. Also, the connector is provided with a sliding member slidable along a longitudinal direction of the connector housing and is configured such that the locking piece comes out of the recess by the slide of the sliding member. The locking piece after coming out of the recess slides on the side surface of the connector housing as the connector moves in a direction of separating away from the cage.

SUMMARY OF THE INVENTION

The connector housing of the connector may be formed by assembling a pair of members. In this case, if a tip portion of the locking piece to slide on a seam between the pair of members is caught by the seam, the connector may not be pulled out from the cage due to the caught locking piece.

It is an object of the invention to provide a connector with a connector housing that is operable to be smoothly pulled out of the cage, as well as a connectorized cable equipped with the connector.

According to an embodiment of the invention, a connector for being fitted to an other member so as to be prevented from disengaging by a locking piece on the other member comprises:

a connector housing comprising a recessed portion engaged with the locking piece; and a sliding member that slidably moves relative to the connector housing so as to disengage the locking piece from the recessed portion, wherein the connector housing is formed by coupling a first housing member and a second housing member, a tip portion of the locking piece coming into sliding contact with a side surface having the recessed portion when removing the connector housing from the other member, and wherein at least a portion of a seam between the first and second housing members on the side surface is inclined relative to a direction of attaching/detaching to/from the other member, the portion being firstly crossed by the tip portion of the locking piece when removing the connector housing from the other member.

According to another embodiment of the invention, a connectorized cable comprises:

a connector for being fitted to an other member so as to be prevented from disengaging by a locking piece on the other member; and a cable portion comprising one end housed in the connector and a linear signal transmission medium, wherein the connector comprises a connector housing comprising a recessed portion engaged with the locking piece, and a sliding member that slidably moves relative to the connector housing so as to disengages the locking piece from the recessed portion, wherein the connector housing is formed by coupling a first housing member and a second housing member, a tip portion of the locking piece coming into sliding contact with a side surface having the recessed portion when removing the connector housing from the other member, and wherein at least a portion of a seam between the first and second housing members on the side surface is inclined relative to a direction of attaching/detaching to/from the other member, the portion being firstly crossed by the tip portion of the locking piece when removing the connector housing from the other member.

According to an embodiment of the invention, a connector with a connector housing can be provided that is operable to be smoothly pulled out of the cage, as well as a connectorized cable equipped with the connector.

BRIEF DESCRIPTION OF THE DRAWINGS

Next, the present invention will be explained in more detail in conjunction with appended drawings, wherein:

FIGS. 5A and 5B are perspective views showing a disengaging portion of a sliding member in a recessed portion of a connector housing, wherein FIG. 5A shows a state in which the sliding member is located closest to the front end side of the connector housing and FIG. 5B shows a state in which the sliding member is located closest to the rear end side of the connector housing;

DETAILED DESCRIPTION OF THE PREFERRED EMBODIMENTS

Embodiment

Figure 1:
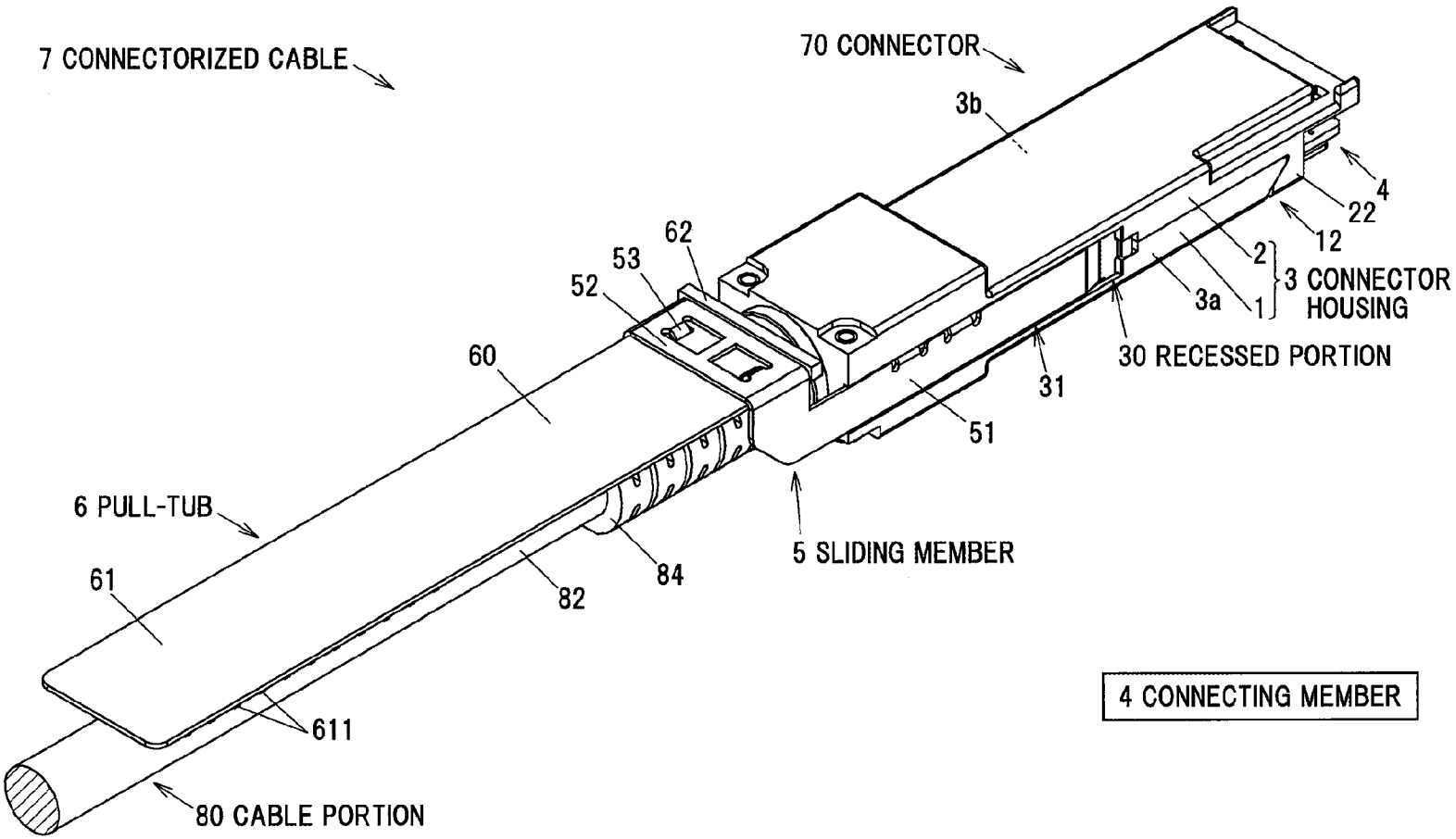
FIG. 1 is a perspective view showing a connectorized cable and a connector in an embodiment of the present invention.
Figure 2:
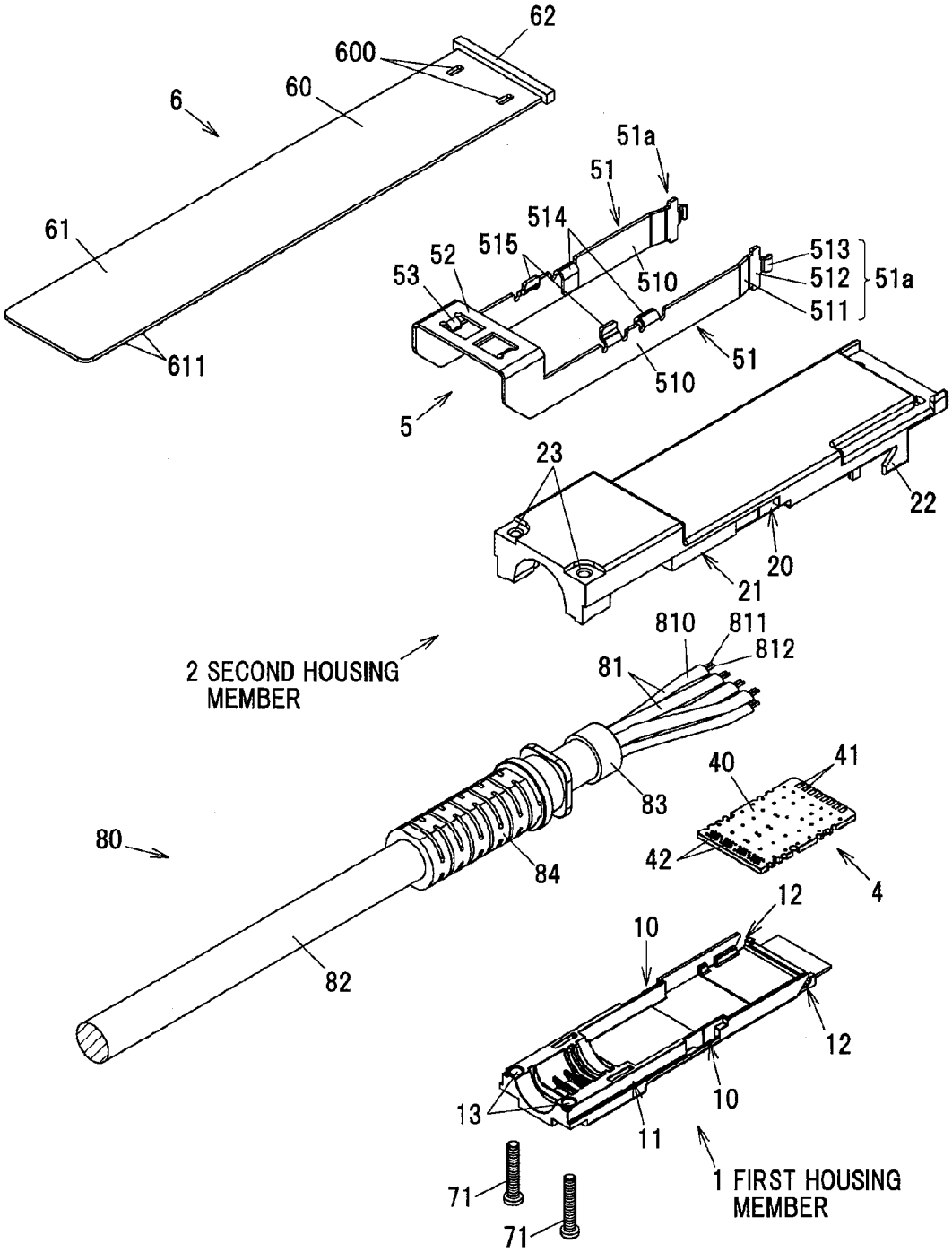
FIG. 2 is an exploded perspective view showing the connectorized cable.

FIG. 1 is a perspective view showing a connectorized cable and a connector in an embodiment of the invention. FIG. 2 is an exploded perspective view showing the connectorized cable. Although the upper side of FIG. 1 is sometimes described as "top/upper" and the lower side of FIG. 1 as "bottom/lower" in the following description for convenience of explanation, "top/upper" and "bottom/lower" are not limited to vertical top and bottom in the usage state of the connectorized cable.

A connectorized cable 7 has a connector 70 and a cable portion 80 of which one end is housed in the connector 70. The connector 70 is a standardized QSFP (Quad Small Form-factor Pluggable) connector. In the present embodiment, the connectorized cable 7 is a cable with electrical connector which transmits an electrical signal through the cable portion 80, and the connector 70 is an electrical connector having plural connection terminals 41.

The cable portion 80 has eight electric wires 81 as linear signal transmission media, a sheath 82 covering the eight electric wires 81 together, a copper ring 83 arranged at an end portion of the sheath 82, and a cylindrical rubber boot 84 fitted on the sheath 82. Each electric wire 81 is a differential signal line which is formed by covering a pair of signal lines 811 and 812 with a resin insulation 810 and transmits a differential signal through the pair of signal lines 811 and 812.

The connector 70 can be attached/detached to/from a cage 9 (see FIG. 4) as another member (described later) and is prevented, when fitted to the cage 9, from disengaging by locking pieces 91 and 92 provided on the cage 9.

The connector 70 is provided with a connector housing 3 formed by coupling a first housing member 1 to a second housing member 2, a connecting member 4 supported on the connector housing 3, a sliding member 5 supported on the connector housing 3 so as to be slidable along a direction of attaching/detaching to/from the cage 9, and a pull-tub 6 coupled to the sliding member 5.

The connector housing 3 is formed in a rectangular parallelepiped shape having its longitudinal direction along the direction of attaching/detaching to/from the cage 9, and is composed of the first housing member 1 and the second housing member 2 which are combined in a direction orthogonal to the longitudinal direction. The first housing member 1 and the second housing member 2 are formed by casting a zinc alloy. Hereinafter, a direction orthogonal to the longitudinal direction of the connector housing 3 as well as orthogonal to a direction of combining the first housing member 1 with the second housing member 2 is defined as a width direction of the connector housing 3, and both widthwise side surfaces of the connector housing 3 are defined as a first side surface 3*a* and a second side surface 3*b*. FIG. 1 shows the connector housing 3 as viewed from the first side surface 3*a* side.

The connecting member 4 is partially exposed from a longitudinal end portion of the connector housing 3. Herein, an end, at which the connecting member 4 is exposed, in the longitudinal direction of the connector housing 3 is called a front end, and the opposite end (on the pull-tub 6 side) is called a rear end.

Recessed portions 30 to be engaged with the locking pieces 91 and 92 of the cage 9 and guide grooves 31 for guiding the sliding member 5 in the longitudinal direction of the connector housing 3 are formed on the connector housing 3. The recessed portion 30 and the guide groove 31 are formed on each of the first side surface 3*a* and the second side surface 3*b* of the connector housing 3. Each recessed portion 30 is formed by combining a first recessed portion 10 of the first housing member 1 with a second recessed portion 20 of the second housing member 2. Meanwhile, each guide groove 31 is formed by combining a first guide groove 11 of the first housing member 1 with a second guide groove 21 of the second housing member 2.

The connecting member 4 is formed by providing plural connection terminals 41 and plural electrodes 42 on a substrate 40 formed of an insulating material such as glass epoxy, and the substrate 40 is held by the connector housing 3. The plural connection terminals 41 are provided in a row at an end of the substrate 40 exposed from the connector housing 3. The plural electrodes 42 are provided at an end of the substrate 40 opposite to the end with the plural connection terminals 41, and are connected to the pairs of signal lines 811 and 812 of the electric wires 81. The plural connection terminals 41 and the plural electrodes 42 are provided on both surfaces of the substrate 40. The plural connection terminals 41 are each formed of a metal foil provided on a surface of the substrate 40 and are connected to the electrodes 42 via a wiring pattern (not shown). The end of the substrate 40 with the plural connection terminals 41 is configured as an end connector.

The sliding member 5 integrally has a pair of arm portions 51 guided by the connector housing 3, a coupling portion 52 coupling the pair of arm portions 51, and a pair of protruding pieces 53 formed by cutting and lifting up a portion of the coupling portion 52. The sliding member 5 is formed by, e.g., punching out and bending a plate material formed of a metal such as stainless steel. The pair of arm portions 51 extend in the longitudinal direction of the connector housing 3 and are supported and guided by the guide grooves 31 of the connector housing 3. The coupling portion 52 couples end portions of the pair of arm portions 51.

Each arm portion 51 has a plate-shaped extending portion 510 which extends in the longitudinal direction of the connector housing 3 and is housed in the guide groove 31 of the connector housing 3. At an end portion of the arm portion 51 opposite to the coupling portion 52, a disengaging portion 51*a* for disengaging the locking piece 91 or 92 from the recessed portion 30 of the connector housing 3 is provided continuously from the extending portion 510.

The disengaging portion 51*a* is composed of an inclined portion 511 inclined relative to the extending portion 510, a flat-plate portion 512 having a plate shape parallel to the extending portion 510 and a curved portion 513 curved into a semi-circular shape. The flat-plate portion 512 is interposed between the inclined portion 511 and the curved portion 513. A distance between the pair of arm portions 51 is smaller between the flat-plate portions 512 than between the extending portions 510.

A first tongue piece 514 to be engaged with the first housing member 1 and a second tongue piece 515 to be engaged with the second housing member 2 are also formed on the arm portion 51. That is, the sliding member 5 slides in the longitudinal direction of the connector housing 3 in the state that the extending portions 510 are housed in the guide grooves 31, the first tongue pieces 514 are engaged with the first housing member 1 and the second tongue pieces 515 are engaged with the second housing member 2.

Then, the slide movement of the sliding member 5 toward the rear end of the connector housing 3 causes the locking pieces 91 and 92 to disengage from the recessed portions 30 of the connector housing 3. The details of this operation will be described later.

The pull-tub 6 is a long plate-shaped member formed of, e.g., a nylon-based resin and has flexibility. In addition, the pull-tub 6 has its longitudinal direction parallel to the longitudinal direction of the connector housing 3 and has an operating portion 61 which is provided at an end in the longitudinal direction and is to be operated when sliding and moving the sliding member 5 toward the rear end of the connector housing 3. On the back side (a surface facing the cable portion 80) of the operating portion 61 of the pull-tub 6, plural ribs 611 are provided so that a worker who carries out removal of the connector 70 from the cage 9 can surely hold the operating portion 61. The worker pulls the operating portion 61 along the longitudinal direction of the pull-tub 6 in a direction of separating away from the connector housing 3 and thereby can slidably move the sliding member 5 toward the rear end of the connector housing 3.

At an end portion of the pull-tub 6 in the longitudinal direction opposite to the operating portion 61, a protrusion 62 is formed so as to protrude in the thickness direction of the pull-tub 6 and to extend in the lateral direction orthogonal to the longitudinal direction of the pull-tub 6. An extended portion 60 having the same width as the operating portion 61 is provided between the operating portion 61 and the protrusion 62.

Two through-holes 600 are formed at an end portion of the extended portion 60 on the protrusion 62 side. The protruding pieces 53 of the sliding member 5 are respectively inserted into the through-holes 600. The protruding pieces 53 are folded back in the width direction of the connector housing 3 so as to have a U-shape when viewing the pull-tub 6 in the longitudinal direction. When the operating portion 61 is pulled, the protrusion 62 butts against the coupling portion 52 of the sliding member 5 and this restricts relative movement of the pull-tub 6 and the sliding member 5 in the longitudinal direction. Meanwhile, since the protruding pieces 53 are inserted through the through-holes 600, the pull-tub 6 is supported on the sliding member 5.

The cable portion 80 is sandwiched and held between a cable holding portion 13 of the first housing member 1 and a cable holding portion 23 of the second housing member 2, and extends out from a rear end portion of the connector housing 3 along the longitudinal direction of the connector housing 3.

A pair of notches 12 inclined relative to the longitudinal direction of the connector housing 3 are formed on the first housing member 1, while a pair of engaging protrusions 22 respectively engaged with the pair of notches 12 are formed on the second housing member 2. The notches 12 and the engaging protrusions 22 are formed on the connector housing 3 at a front end portion in the longitudinal direction. In addition, two bolt insertion holes 13 for insertion of the two bolts 71 are formed on the first housing member 1, while two tapped holes 23 into which the two bolts are respectively threaded are formed on the second housing member 2. The bolt insertion holes 13 and the tapped holes 23 are formed on the connector housing 3 at a rear end portion in the longitudinal direction.

That is, the engaging protrusions 22 formed on the second housing member 2 and the notches 12 formed on the first housing member 1 are engaged at one end of the connector housing 3 in a direction of attaching/detaching to/from the cage 9, a pair of bolts 71 are tightened at the other end of the connector housing 3 in the attaching/detaching direction, and the first housing member 1 is thereby coupled to the second housing member 2.

Figure 3A:
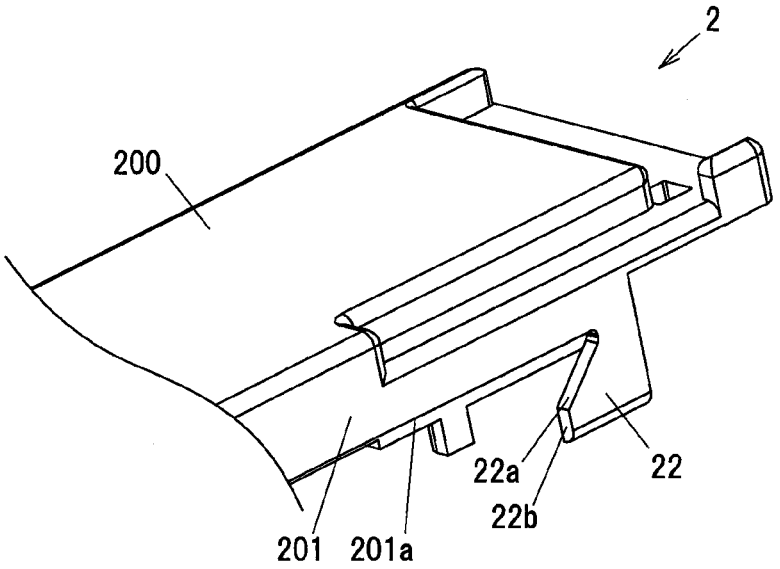
FIG. 3A is an enlarged perspective view showing the periphery of an engaging protrusion of a second housing member.
Figure 3B:
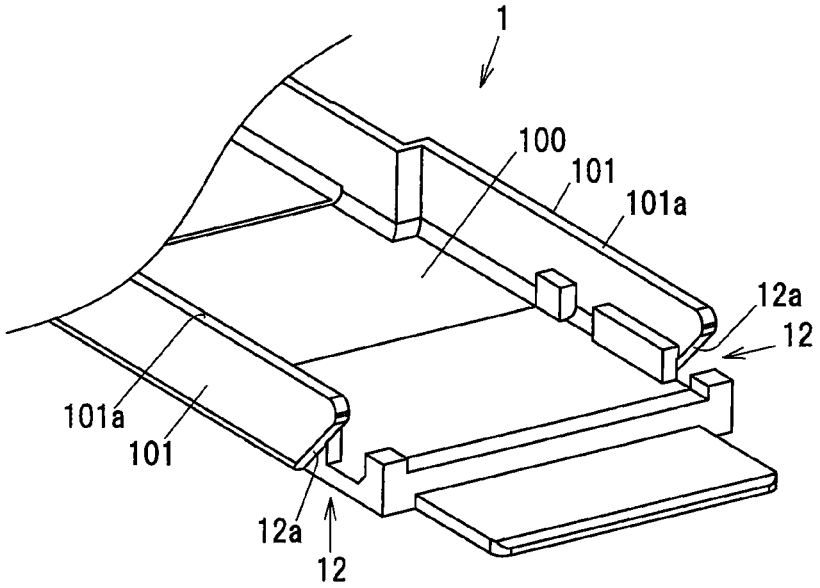
FIG. 3B is an enlarged perspective view showing the periphery of notches of a first housing member.

FIG. 3A is an enlarged perspective view showing the periphery of the engaging protrusion 22 of the second housing member 2 and FIG. 3B is an enlarged perspective view showing the periphery of the notches 12 of the first housing member 1.

As shown in FIG. 3A, the second housing member 2 has a plate-shaped upper wall 200 orthogonal to the direction of combining the first housing member 1 with the second housing member 2, and a pair of sidewalls 201 upstanding toward the first housing member 1 from both ends of the upper wall 200 in the width direction of the connector housing 3. In FIG. 3A, only one sidewall 201 which constitutes a portion of the first side surface 3*a* of the connector housing 3 is shown. Each engaging protrusion 22 is formed as a portion of the sidewall 201 on the front end side of the connector housing 3.

An end face of the engaging protrusion 22 on the rear end side in the longitudinal direction of the connector housing 3 is composed of an inclined surface 22*a* inclined relative to the direction of combining the first housing member 1 with the second housing member 2, and a parallel surface 22*b* parallel to the direction of combining the first housing member 1 with the second housing member 2. The inclined surface 22*a* is located on the upper wall 200 side relative to the parallel surface 22*b* and is inclined so as to get close to the parallel surface 22*b* toward the rear end of the connector housing 3. Therefore, the farther from the upper wall 200, the wider the width of the engaging protrusion 22 in the longitudinal direction of the connector housing 3 within the range in which the inclined surface 22*a* is formed. Meanwhile, a lower end face 201*a* of the sidewall 201 of the second housing member 2 is parallel to the longitudinal direction of the connector housing 3. An angle formed between the lower end face 201*a* and the inclined surface 22*a* is an acute angle.

Meanwhile, as shown in FIG. 3B, the first housing member 1 has a plate-shaped lower wall 100 orthogonal to the direction of combining the first housing member 1 with the second housing member 2, and a pair of sidewalls 101 upstanding toward the second housing member 2 from both ends of the lower wall 100 in the width direction of the connector housing 3. Each notch 12 is formed on the sidewall 101 on the front end side of the connector housing 3.

An end face of the sidewall 101 of the first housing member 1 on the front end side in the longitudinal direction of the connector housing 3 is formed as an inclined surface 12*a* which is parallel to the inclined surface 22*a* of the engaging protrusion 22. The inclined surface 12*a* is a notched surface of the notch 12 and is inclined so as to separate away from the lower wall 100 toward the front end of the connector housing 3. Meanwhile, an upper end face 101*a* of the sidewall 101 of the first housing member 1 is parallel to the longitudinal direction of the connector housing 3. An angle formed between the upper end face 101*a* and the inclined surface 12*a* of the notch 12 is an acute angle.

Engagement of the engaging protrusions 22 of the second housing member 2 with the notches 12 of the first housing member 1 restricts relative movement of the first housing member 1 and the second housing member 2 in a direction of separating the upper wall 200 and the lower wall 100. Then, a seam between the first housing member 1 and the second housing member 2 is formed between the upper end faces 101*a* of the sidewalls 101 and the lower end faces 201*a* of the sidewalls 201 and between the inclined surfaces 22*a* of the engaging protrusions 22 and the inclined surfaces 12*a* of the notches 12.

Figure 4A:
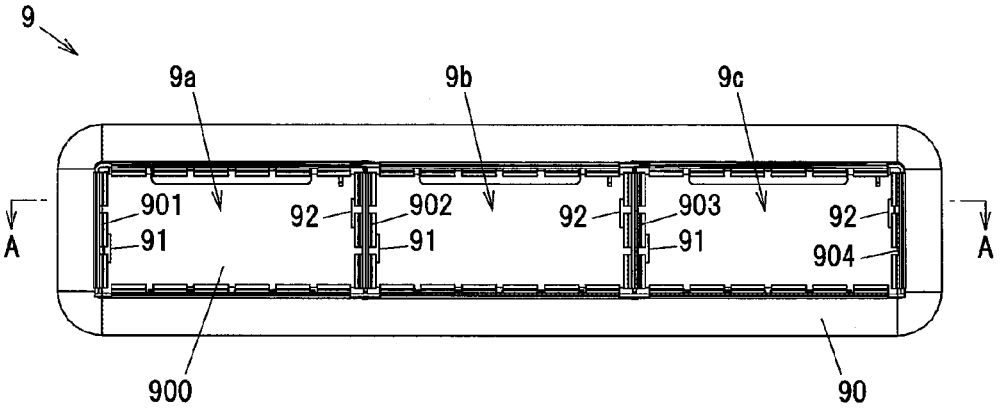
FIG. 4A is a front view showing a cage into which the connector is inserted.
Figure 4B:
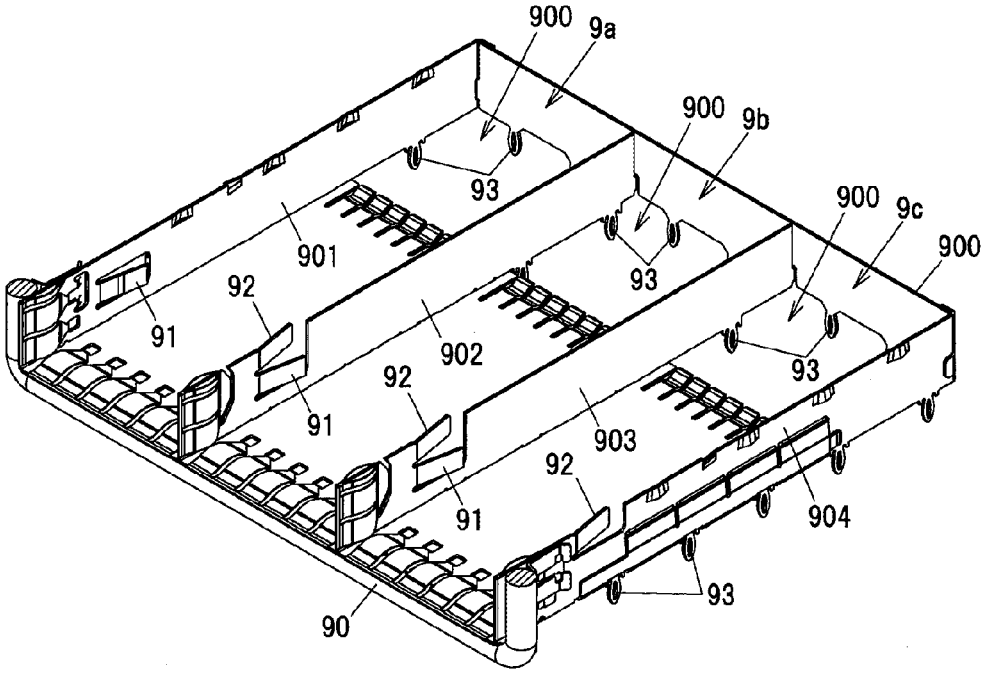
FIG. 4B is a perspective view showing a cutaway bottom part of the cage cut along a line A-A in FIG. 4A.

FIG. 4A is a front view showing the cage 9 to which the connector 70 is fitted and FIG. 4B is a perspective sectional view diagonally showing the cage 9 taken on line A-A of FIG. 4A. The cage 9 is formed of a conductive metal and has an electromagnetic wave shielding function.

The cage 9 is a 3-port cage allowing three connectors 70 to be fitted, and has first to third fitting portions 9*a*, 9*b* and 9*c*. In the cage 9, each of the first to third fitting portions 9*a*, 9*b* and 9*c* has the locking pieces 91 and 92. The cage 9 is to be mounted on a printed circuit board (not shown) and has plural terminals 93 for electrically connecting and fixing to a ground conductor formed on the printed circuit board. In the following description, the locking piece 91 provided on the printed circuit board side is referred to as "lower locking piece 91", and the locking piece 92 located farther from the printed circuit board is referred to as "upper locking piece 92". That is, the cage 9 is provided with three lower locking pieces 91 and three upper locking pieces 92.

The cage 9 has first to fourth wall portions 901 to 904 which extend along the direction of attaching/detaching the connector 70. The first wall portion 901 has one lower locking piece 91 formed by cutting and lifting up a portion thereof Meanwhile, each of the second and third wall portions 902 and 903 has one lower locking piece 91 and one upper locking piece 92 which are formed by cutting and lifting up a portion thereof Then, the fourth wall portion 904 has one upper locking piece 92. The second wall portion 902 separates the first fitting portion 9*a* from the second fitting portion 9*b*, and the third wall portion 903 separates the second fitting portion 9*b* from the third fitting portion 9*c*.

A rectangular frame 90 is provided on the front side of the cage 9, and the connectors 70 are inserted into the first to third fitting portions 9*a*, 9*b* and 9*c* from the frame 90 side. Each of the first to third fitting portions 9*a*, 9*b* and 9*c* has an opening 900 on the back side (the opposite side to the frame 90) so that other connectors (not shown) provided on the printed circuit board can be inserted into the first to third fitting portions 9*a*, 9*b* and 9*c*. The connecting member 4 of the connector 70 is connected to one of the other connectors.

Next, an operation to disengage the lower locking piece 91 and the upper locking piece 92 from the recessed portions 30 of the connector housing 3 will be described in reference to FIGS. 5A and 5B.

Figure 5A:
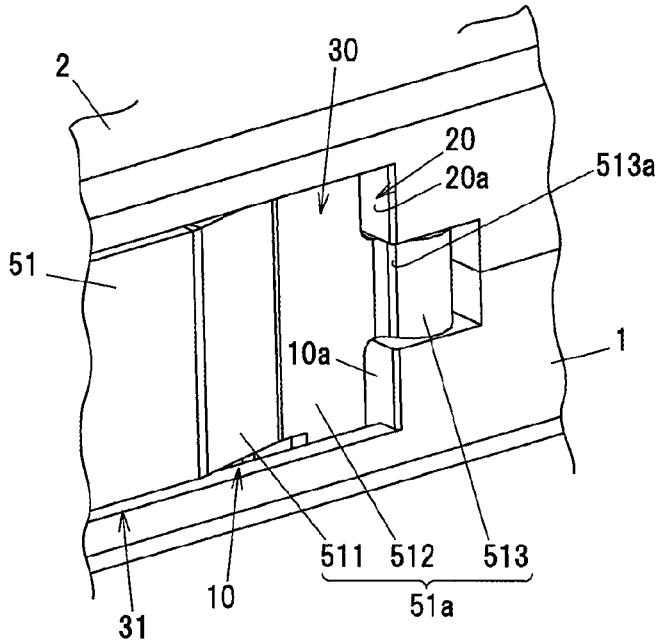
Figure 5B:
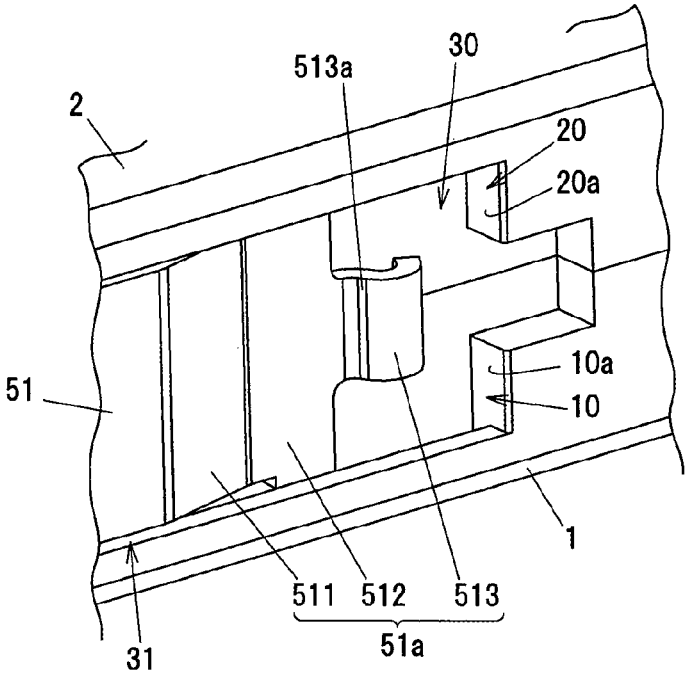

FIGS. 5A and 5B are perspective views showing a disengaging portion 51*a* of the sliding member 5 in the recessed portion 30 of the connector housing 3, wherein FIG. 5A shows a state in which the sliding member 5 is located closest to the front end side of the connector housing 3 and FIG. 5B shows a state in which the sliding member 5 is located closest to the rear end side of the connector housing 3. Although only the recessed portion 30 on the first side surface 3*a* of the connector housing 3 is shown in FIGS. 5A and 5B, the recessed portion 30 on the second side surface 3*b* also has the same configuration.

When the connector 70 is fitted to one of the first to third fitting portions 9*a*, 9*b* and 9*c* of the cage 9, the lower locking piece 91 and the upper locking piece 92 are respectively engaged with the pair of recessed portions 30 of the connector housing 3. When a force in a direction of removing from the cage 9 is applied to the connector housing 3 in this state, a tip portion of the lower locking piece 91 butts against a contact surface 10*a* of the first recessed portion 10 of the first housing member 1 and a tip portion of the upper locking piece 92 butts against a contact surface 20*a* of the second recessed portion 20 of the second housing member 2. This prevents the connector housing 3 from disengaging.

Meanwhile, when removing the connector 70 from the cage 9, a worker holds the operating portion 61 of the pull-tub 6 and pulls the pull-tub 6. Then, the sliding member 5 coupled to the pull-tub 6 slides relative to the connector housing 3 toward the rear end. Due to the slide movement, the lower locking piece 91 and the upper locking piece 92 come into contact with outer surfaces 513*a* of the curved portions 513 of the disengaging portions 51*a* and receive a force in a direction to come out from the recessed portions 30, and the lower locking piece 91 and the upper locking piece 92 are disengaged from the recessed portions 30 of the connector housing 3. This allows the connector 70 to be removed from the cage 9.

Figure 6A:
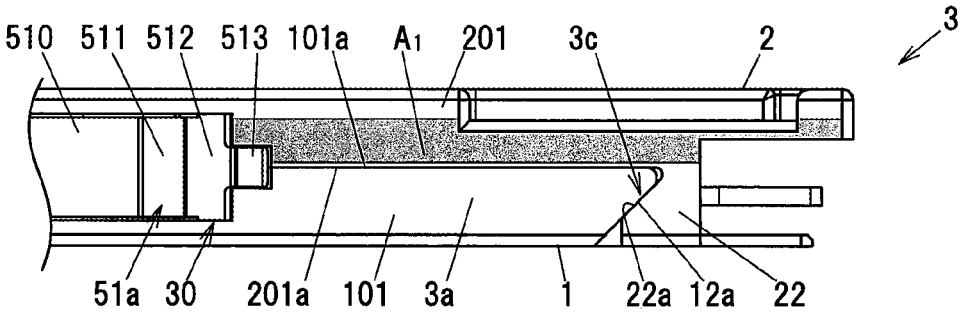
FIG. 6A is a side view showing one side surface of the connector housing.
Figure 6B:
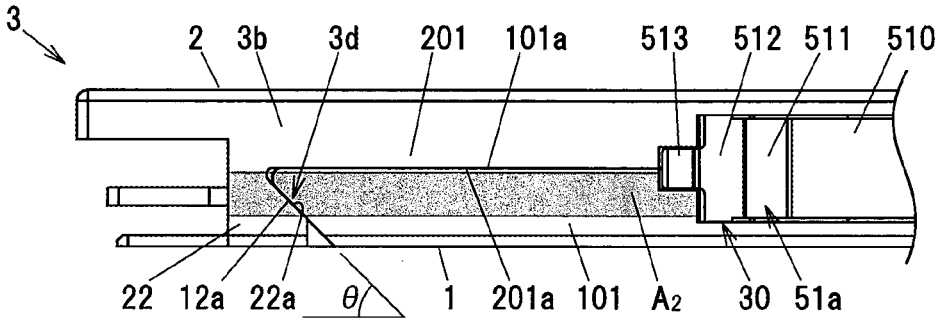
FIG. 6B is a side view showing the other side surface of the connector housing.

FIG. 6A is a side view showing the first side surface 3*a* of the connector housing 3, and FIG. 6B is a side view showing the second side surface 3*b* of the connector housing 3.

The upper engaging piece 92, which is disengaged from the recessed portion 30 on the first side surface 3a, slides on the sidewall 201 of the second housing member 2 when removing the connector housing 3 from the cage 9. A shaded area in FIG. 6A is a range $A_1$ in which the tip portion of the upper engaging piece 92 comes into sliding contact with the sidewall 201 of the second housing member 2.

Meanwhile, the lower-engaging piece 91, which is disengaged from the recessed portion 30 on the second side surface 3*b*, slides on the sidewall 101 of the first housing member 1 as well as on the engaging protrusion 22 of the second housing member 2 when removing the connector housing 3 from the cage 9. A shaded area in FIG. 6B is a range $A_2$ in which the tip portion of the lower engaging piece 91 comes into sliding contact with the sidewall 101 of the first housing member 1 and with the engaging protrusion 22 of the second housing member 2.

As shown in FIG. 6A, the seam between the first housing member 1 and the second housing member 2 is not included in the sliding contact range $A_1$ of the upper engaging piece 92. Thus, the upper engaging piece 92 does not cross a seam 3*c* between the inclined surface 22*a* of the engaging protrusion 22 and the inclined surface 12*a* of the notch 12 on the first side surface 3*a* when removing the connector housing 3 from the cage 9.

On the other hand, as shown in FIG. 6B, a seam 3*d* between the inclined surface 22*a* of the engaging protrusion 22 and the inclined surface 12*a* of the notch 12 is included in the sliding contact range $A_2$ of the lower engaging piece 91 on the second side surface 3*b* side. An inclination angle θ of the seam 3*d* relative to the longitudinal direction of the connector housing 3 (the direction of attaching/detaching to/from the cage 9) is not less than 30° and not more than 60°. This angular range is determined so that the tip portion of the lower engaging piece 91 surely passes across the seam 3*d* and also processability for manufacturing the first housing member 1 and the second housing member 2 is not impaired. In the example shown in FIG. 6B, the inclination angle θ is 45°.

On each of the widthwise side surfaces (the first side surface 3*a* and the second side surface 3*b*) of the connector housing 3, the seam between the upper end face 101*a* of the sidewall 101 of the first housing member 1 and the lower end face 201*a* of the sidewall 201 of the second housing member 2 is not included in the sliding contact range $A_1$ of the upper engaging piece 92 and the sliding contact range $A_2$ of the lower engaging piece 91.

Figure 7A:
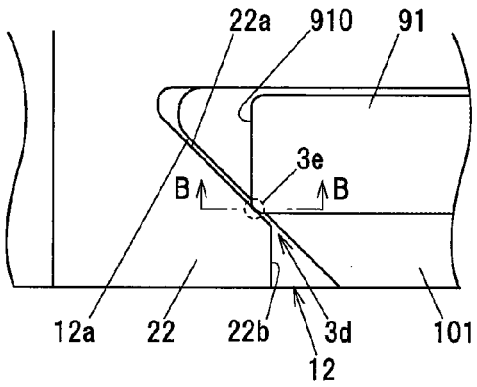
FIG. 7A is an illustration diagram showing a state in which a tip portion of a lower locking piece crosses a seam between the first and second housing members.
Figure 7B:
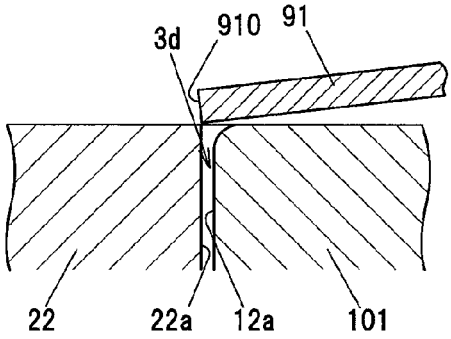
FIG. 7B is a cross sectional view taken along a line B-B in FIG. 7A.

FIG. 7A is an illustration diagram showing the state in which a tip portion 910 of the lower engaging piece 91 disengaged from the recessed portion 30 crosses the seam 3*d* between the engaging protrusion 22 and the notch 12 when removing the connector housing 3 from the cage 9. FIG. 7B is a cross sectional view taken along the line B-B in FIG. 7A and showing a portion of the seam 3*d* which is firstly crossed by the tip portion 910 of the lower engaging piece 91.

In the present embodiment, the entire seam 3*d* including a first crossing portion 3*e* is inclined at a certain angle relative to the direction of attaching/detaching the connector housing 3 to/from the cage 9. That is, on the second side surface 3*b* side, the seam between the first housing member 1 and the second housing member 2 has a portion which is firstly crossed by the tip portion 910 of the lower engaging piece 91 when removing the connector housing 3 from the cage 9 and this portion (hereinafter, referred to as "the first crossing portion 3*e*") is inclined relative to the direction of attaching/detaching the connector housing 3 to/from the cage 9. Then, an inclination angle of the first crossing portion 3*e* of the seam 3*d* relative to the direction of attaching/detaching the connector housing 3 to/from the cage 9 (i.e., the inclination angle θ) is not less than 30° and not more than 60°, as described above.

In such a configuration, when the tip portion 910 of the lower engaging piece 91 crosses the first crossing portion 3*e* of the seam 3*d*, the tip portion 910 except a lower end in a width direction of the lower engaging piece 91 (in a vertical direction in FIG. 7A) is in contact with the sidewall 101 of the first housing member 1. Therefore, even when there is a gap between the inclined surface 22*a* of the engaging protrusion 22 and the inclined surface 12*a* of the notch 12, the tip portion 910 of the lower engaging piece 91 does not get in the gap (see FIG. 7B).

Such a gap is formed due to, e.g., machining error of one or both of the first housing member 1 and the second housing member 2. Meanwhile, the tip portion 910 of the lower engaging piece 91 is likely to get in the seam 3*d* when the corner of the inclined surface 12*a* of the notch 12 on the second side surface 3*b* is rounded as shown in FIG. 7B. However, the configuration described above prevents the tip portion 910 of the lower engaging piece 91 from getting in the seam 3*d* even when such a rounded portion is present. Therefore, the lower engaging piece 91 is not caught on the seam 3*d* when removing the connector housing 3 from the cage 9 and it is therefore possible to smoothly pull the connector housing 3 out from the cage 9.

Comparative Example

Figure 8A:
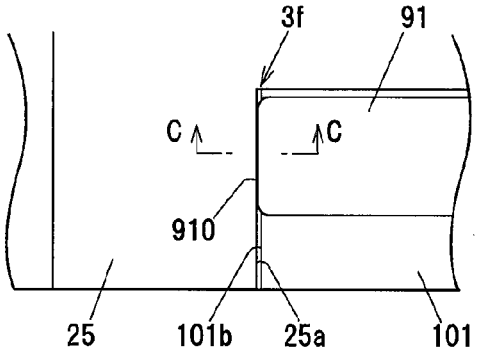
FIG. 8A is a side view showing Comparative Example in which the seam between the first and second housing members, which crosses the tip portion of the lower locking piece, extends in a direction orthogonal to a direction of removing the connector housing from the cage.
Figure 8B:
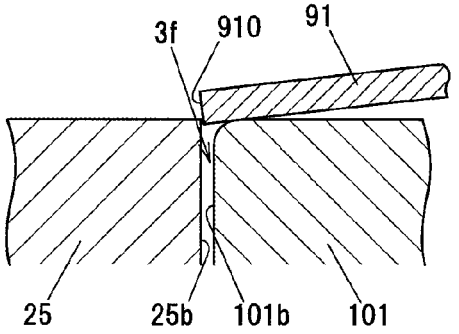
FIG. 8B is a cross sectional view taken along a line C-C in FIG. 8A.

FIG. 8A shows Comparative Example in which a seam 3f between the first housing member 1 and the second housing member 2, which crosses the tip portion 910 of the lower locking piece 91, extends in a direction orthogonal to the direction of removing the connector housing 3 from the cage 9. FIG. 8B is a cross sectional view taken along the line C-C in FIG. 8A.

In Comparative Example, an end face 101*b* on the rear end side of the sidewall 101 of the first housing member 1 is orthogonal to the direction of attaching/detaching the connector housing 3 to/from the cage 9, and an end face 25*a* of a protrusion 25 of the second housing member 2 which is a surface facing the end face 101*b* is also orthogonal to the direction of attaching/detaching the connector housing 3 to/from the cage 9.

In this case, if a gap is present at the seam 3f between the end face 101*b* of the sidewall 101 and the end face 25*a* of the protrusion 25, the tip portion 910 of the lower engaging piece 91 may be caught on the seam 3f, as shown in FIG. 8B. The caught lower engaging piece 91 causes a problem for removing the connector housing 3 from the cage 9 and it is not possible to separate the connector housing 3 from the cage 9 unless, e.g., the cage 9 is disassembled.

Functions and Effects of the Embodiment

The following functions and effects are obtained in the embodiment.

(1) Since the seam between the first housing member 1 and the second housing member 2 has a portion (the first crossing portion 3*e*) which is firstly crossed by the tip portion 910 of the lower engaging piece 91 when removing the connector housing 3 from the cage 9 and this portion is inclined relative to the direction of attaching/detaching to/from the cage 9, the lower engaging piece 91 is prevented from being caught on the connector housing 3. It is therefore possible to smoothly pull the connector housing 3 out from the cage 9.

(2) Since the inclination angle θ of the first crossing portion 3*e* of the seam between the first housing member 1 and the second housing member 2 is not less than 30° and not more than 60°, the tip portion 910 of lower engaging piece 91 surely passes across the seam 3*d* between the engaging protrusion 22 and the notch 12, and also, it is possible to prevent processability for manufacturing the first housing member 1 and the second housing member 2 from being impaired. In detail, if the inclination angle θ is less than 30°, processability of the inclined surface 22*a* of the engaging protrusion 22 and the inclined surface 12*a* of the notch 12 decreases and machining error is likely to occur. When the inclination angle θ is more than 60°, the tip portion 910 of lower engaging piece 91 may not easily pass across the seam 3*d*. On the other hand, in the present embodiment, since the inclination angle θ is adjusted to not less than 30° and not more than 60°, processability during manufacturing is not impaired and the tip portion 910 of lower engaging piece 91 can smoothly pass across the seam 3*d*.

(3) In the present embodiment, the first housing member 1 is coupled to the second housing member 2 by engagement of the engaging protrusions 22 with the notches 12 at the front end portion of the connector housing 3 and tightening of the pair of bolts 71 at the rear end portion. Thus, the connector housing 3 can be formed more easily than, e.g., when forming the connector housing 3 as an integrated polygonal cylinder or when tightening bolts at both longitudinal end portions. In addition, in the configuration in which the engaging protrusions 22 are engaged with the notches 12 as described above, the seam 3*d* therebetween crosses the lower engaging piece 91 of the cage 9 but, in the present embodiment, the tip portion 910 of lower engaging piece 91 is prevented from being caught on the seam 3*d*. Therefore, it is possible to smoothly pull the connector housing 3 out from the cage 9 and it is also easy to form the connector housing 3.

Summary of the Embodiment

Technical ideas understood from the embodiment will be described below citing the reference numerals etc. used for the embodiment. However, each reference numeral described below is not intended to limit the constituent elements in the claims to the members etc. specifically described in the embodiment.

[1] A connector (70) for being fitted to an other member (9) so as to be prevented from disengaging by locking pieces (91, 92) provided on the other member (9), the connector (70) comprising: a connector housing (3) comprising a recessed portion (30) engaged with the locking pieces (91, 92); and a sliding member (5) that slidably moves relative to the connector housing (3) so as to disengage the locking pieces (91, 92) from the recessed portion (30), wherein the connector housing (3) is formed by coupling a first housing member (1) and a second housing member (2), a tip portion (910) of the locking piece (91) coming into sliding contact with a side surface (3*b*) having the recessed portion (30) when removing the connector housing (3) from the other member (9), and wherein at least a portion (3*e*) of a seam (3*d*) between the first housing member (1) and the second housing member (2) on the side surface (3*b*) is inclined relative to a direction of attaching/detaching to/from the other member (9), the portion (3*e*) being firstly crossed by the tip portion (910) of the locking piece (91) when removing the connector housing (3) from the other member (9).

[2] The connector (70) defined by [1], wherein the portion (3*e*) of the seam (3*d*) is inclined not less than 30° and not more than 60° relative to the attaching/detaching direction.

[3] The connector (70) defined by [1] or [2], wherein the first housing member (1) and the second housing member (2) are coupled by engagement of engaging protrusions (22) on the second housing member (2) with notches (12) on the first housing member (1) at one end of the connector housing (3) in the attaching/detaching direction and tightening of bolts (71) at another end of the connector housing (3) in the attaching/detaching direction, and a seam between the engaging protrusion (22) and the notch (12) comprises the portion (3*e*) that is firstly crossed by the tip portion (910) of the locking piece (91) when removing the connector housing (3) from the other member (9).

[4] A connectorized cable (7) comprising: the connector (70) defined by any one of [1] to [3]; and a cable portion (80) comprising one end housed in the connector (70) and a linear signal transmission medium (81).

Although the embodiment of the invention has been described, the invention according to claims is not to be limited to the embodiment. Further, please note that all combinations of the features described in the embodiment are not necessary to solve the problem of the invention.

In addition, the invention can be appropriately modified and implemented. For example, although the signal transmission media of the cable portion 80 are the electric wires 81 in the embodiment, it is not limited thereto. The signal transmission media of the cable portion 80 may be optical fibers. In this case, the connector 70 has an optical adapter in place of the connecting member 4. Alternatively, the signal transmission media of the cable portion 80 may be a combination of the electric wires 81 and optical fibers.

In addition, although the entire seam 3*d* including the first crossing portion 3*e* is inclined at a certain angle relative to the direction of attaching/detaching the connector housing 3 to/from the cage 9 in the embodiment, it is not limited thereto. If the seam 3*d* between the engaging protrusion 22 and the notch 12 is inclined at least at a portion being firstly crossed by the tip portion 910 of the lower engaging piece 91, the remaining portion may be orthogonal to the direction of attaching/detaching to/from the cage 9. Even in this case, once a portion of the lower engaging piece 91 passes across the seam 3*d*, the other portion of the lower engaging piece 91 is not caught on the seam 3*d*. In other words, the seam between the first housing member 1 and the second housing member 2 on the side surface of the connector housing 3 only needs to be inclined relative to the direction of attaching/detaching to/from the cage 9 at least at the portion being firstly crossed by the tip portion 910 of the lower engaging piece 91 when removing the connector housing 3 from the cage 9.

What is claimed is:

1. A connector for being fitted to another member so as to be prevented from disengaging by a locking piece on the other member, the connector comprising:

a connector housing comprising a recessed portion engaged with the locking piece; and a sliding member that slidably moves relative to the connector housing so as to disengage the locking piece from the recessed portion, wherein the connector housing is formed by coupling a first housing member and a second housing member, a tip portion of the locking piece coming into sliding contact with a side surface having the recessed portion when removing the connector housing from the other member, and wherein at least a portion of a seam between the first and second housing members on the side surface is inclined relative to a direction of attaching/detaching to/from the other member, the inclined portion of a seam being firstly crossed by the tip portion of the locking piece when removing the connector housing from the other member, wherein the sliding member integrally comprises a pair of arm portions guided by the connector housing, a coupling portion coupling the pair of arm portions, and a pair of protruding pieces.

2. The connector according to claim 1, wherein the portion of the seam is inclined not less than 30° and not more than 60° relative to the attaching/detaching direction.

3. The connector according to claim 1, wherein the first and second housing members are coupled by engagement of engaging protrusions on the second housing member with notches on the first housing member at one end of the connector housing in the attaching/detaching direction and tightening of a bolt at another end of the connector housing in the attaching/detaching direction, wherein the portion of a seam comprises a seam region between the engaging protrusion and the notch, and wherein the seam region comprises the portion of a seam that is firstly crossed by the tip portion of the locking piece when removing the connector housing from the other member.

4. The connector according to claim 2, wherein the first and second housing members are coupled by engagement of engaging protrusions on the second housing member with notches on the first housing member at one end of the connector housing in the attaching/detaching direction and tightening of a bolt at another end of the connector housing in the attaching/detaching direction, wherein the portion of a seam comprises a seam region between the engaging protrusion and the notch, and wherein the seam region comprises the portion of a seam that is firstly crossed by the tip portion of the locking piece when removing the connector housing from the other member.

5. The connector according to claim 1, wherein the arm portions each comprise a first tongue piece to be engaged with the first housing member and a second tongue piece to be engaged with the second housing member.

6. The connector according to claim 1, further comprising a pull-tub coupled to the sliding member, wherein the pair of protruding pieces of the sliding member are inserted through a though-hole formed on the pull-tub.

7. The connector according to claim 1, further comprising, a pull-tub coupled to the sliding member, wherein the pull-tub comprises a protrusion extending in a lateral direction orthogonal to the longitudinal direction of the pull-tub, and wherein the protrusion of the pull-tub butts against the coupling portion of the sliding member.

8. A connectorized cable, comprising: a connector for being fitted to another member so as to be prevented from disengaging by a locking piece on the other member; and a cable portion comprising one end housed in the connector and a linear signal transmission medium, wherein the connector comprises a connector housing comprising a recessed portion engaged with the locking piece, and a sliding member that slidably moves relative to the connector housing so as to disengages the locking piece from the recessed portion, wherein the connector housing is formed by coupling a first housing member and a second housing member, a tip portion of the locking piece coming into sliding contact with a side surface having the recessed portion when removing the connector housing from the other member, and wherein at least a portion of a seam between the first and second housing members on the side surface is inclined relative to a direction of attaching/detaching to/from the other member, the inclined portion of a seam being firstly crossed by the tip portion of the locking piece when removing the connector housing from the other member, wherein the sliding member integrally comprises a pair of arm portions guided by the connector housing, a coupling portion coupling the pair of arm portions, and a pair of protruding pieces.

9. The connectorized cable according to claim 8, wherein the portion of the seam is inclined not less than 30° and not more than 60° relative to the attaching/detaching direction.

10. The connectorized cable according to claim 8, wherein the first and second housing members are coupled by engagement of engaging protrusions on the second housing member with notches on the first housing member at one end of the connector housing in the attaching/detaching direction and tightening of bolts at another end of the connector housing in the attaching/detaching direction, wherein the portion of a seam comprises a seam region between the engaging protrusion and the notch, and wherein the seam region comprises the portion of a seam that is firstly crossed by the tip portion of the locking piece when removing the connector housing from the other member.

11. The connectorized cable according to claim 9, wherein the first and second housing members are coupled by engagement of engaging protrusions on the second housing member with notches on the first housing member at one end of the connector housing in the attaching/detaching direction and tightening of a bolt at another end of the connector housing in the attaching/detaching direction, wherein the portion of a seam comprises a seam region between the engaging protrusion and the notch, and wherein the seam region comprises the portion of a seam that is firstly crossed by the tip portion of the locking piece when removing the connector housing from the other member.

12. The connectorized cable according to claim 8, wherein the sliding member integrally comprises a pair of arm portions guided by the connector housing, a coupling portion coupling the pair of arm portions, and a pair of protruding pieces formed by cutting and lifting up a portion of the coupling portion.

13. The connectorized cable according to claim 12, wherein the arm portions each comprise a first tongue piece to be engaged with the first housing member and a second tongue piece to be engaged with the second housing member.

14. The connectorized cable according to claim 12, further comprising a pull-tub coupled to the sliding member, wherein the pair of protruding pieces of the sliding member are inserted through a though-hole formed on the pull-tub.

15. The connectorized cable according to claim 12, further comprising a pull-tub coupled to the sliding member, wherein the pull-tub comprises a protrusion extending in a lateral direction orthogonal to the longitudinal direction of the pull-tub, and wherein the protrusion of the pull-tub butts against the coupling portion of the sliding member.

16. The connector according to claim 1, wherein the sliding member integrally comprises a pair of arm portions, each of which comprises a plane-shaped extending portion extending in the longitudinal direction of the connector housing and a disengaging portion so as to disengage the locking piece from the recessed portion, which is provided continuously from the extending portion at an end portion of the arm portion opposite to the coupling portion.

17. The connector according to claim 16, wherein the disengaging portion comprises an inclined portion inclined relative to the extending portion, a flat-plate portion having a plate shape parallel to the extending portion, and a curved portion curved into a semi-circular shape; and wherein the flat-plate portion is interposed between the inclined portion and the curved portion and a distance between the pair of arm portion is smaller between the flat-plate portions than between the extending portions.

18. The connectorized cable according to claim 8, wherein the sliding member integrally comprises a pair of arm portions, each of which comprises a plane-shaped extending portion extending in the longitudinal direction of the connector housing and a disengaging portion so as to disengage the locking piece from the recessed portion, which is provided continuously from the extending portion at an end portion of the arm portion opposite to the coupling portion.

19. The connectorized cable according to claim 18, wherein the disengaging portion comprises an inclined portion inclined relative to the extending portion, a flat-plate portion having a plate shape parallel to the extending portion, and a curved portion curved into a semi-circular shape; and wherein the flat-plate portion is interposed between the inclined portion and the curved portion and a distance between the pair of arm portion is smaller between the flat-plate portions than between the extending portions.

* * * * *